US007988523B2

(12) United States Patent
Chang et al.

(10) Patent No.: US 7,988,523 B2
(45) Date of Patent: Aug. 2, 2011

(54) EYE

(75) Inventors: Jen-Tsorng Chang, Taipei Hsien (TW); Chun-Yu Lee, Taipei Hsien (TW); Tsung-Yu Lin, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 303 days.

(21) Appl. No.: 12/406,184

(22) Filed: Mar. 18, 2009

(65) Prior Publication Data

US 2010/0003892 A1 Jan. 7, 2010

(30) Foreign Application Priority Data

Jul. 1, 2008 (CN) ..... 2008 1 0302470

(51) Int. Cl.
*A63H 3/38* (2006.01)

(52) U.S. Cl. ..... 446/392; 446/389

(58) Field of Classification Search ..... 446/341, 446/389, 392, 393, 394, 342, 343, 344, 347, 446/348, 352
See application file for complete search history.

(56) References Cited

U.S. PATENT DOCUMENTS

| | | | | |
|---|---|---|---|---|
| 4,601,673 | A * | 7/1986 | Nasca | 446/389 |
| 4,629,442 | A * | 12/1986 | Samo | 446/389 |
| 7,485,025 | B2 * | 2/2009 | Schnuckle | 446/392 |
| 7,682,217 | B2 * | 3/2010 | Hsu | 446/343 |
| 2004/0106353 | A1 * | 6/2004 | Chang | 446/392 |
| 2008/0139082 | A1 * | 6/2008 | Schnuckle | 446/392 |

* cited by examiner

*Primary Examiner* — Nini Legesse
(74) *Attorney, Agent, or Firm* — Clifford O. Chi

(57) ABSTRACT

An eye is disclosed, which includes a spherical shell, a transparent body, a movable plate suspended inside the spherical shell, an elastic body disposed between the transparent body and the movable plate, and an electromagnetic driving device. The electromagnetic driving device drives the movable plate close to or away from the elastic body, and the elastic body is deformed when the electromagnetic driving assembly drives the movable plate.

8 Claims, 3 Drawing Sheets

EYE

BACKGROUND

1. Field of the Invention

This invention generally relates to artificial eyes, and more particularly to an artificial eye ball for use in a toy.

2. Description of Related Art

As manufacturing technology develops, requirements for toys and novelties to feature enhanced and innovative function increase. One example is the authenticity of behavior exhibited by human or animal figures, and specifically, the eyes of such a toy.

In many artificial eyes, expansion and contraction of a pupil are achieved by mechanical transmission driven by electrical motors. However, such mechanical structures controlling expansion and contraction of a pupil are complicated, and the effects tend to be far from lifelike. Furthermore, such controllers and electrical motors are easily damaged and have short lifetimes.

DETAILED DESCRIPTION OF THE EMBODIMENTS

An embodiment of the disclosure is now described in detail and with reference to the drawings.

Figure 1:
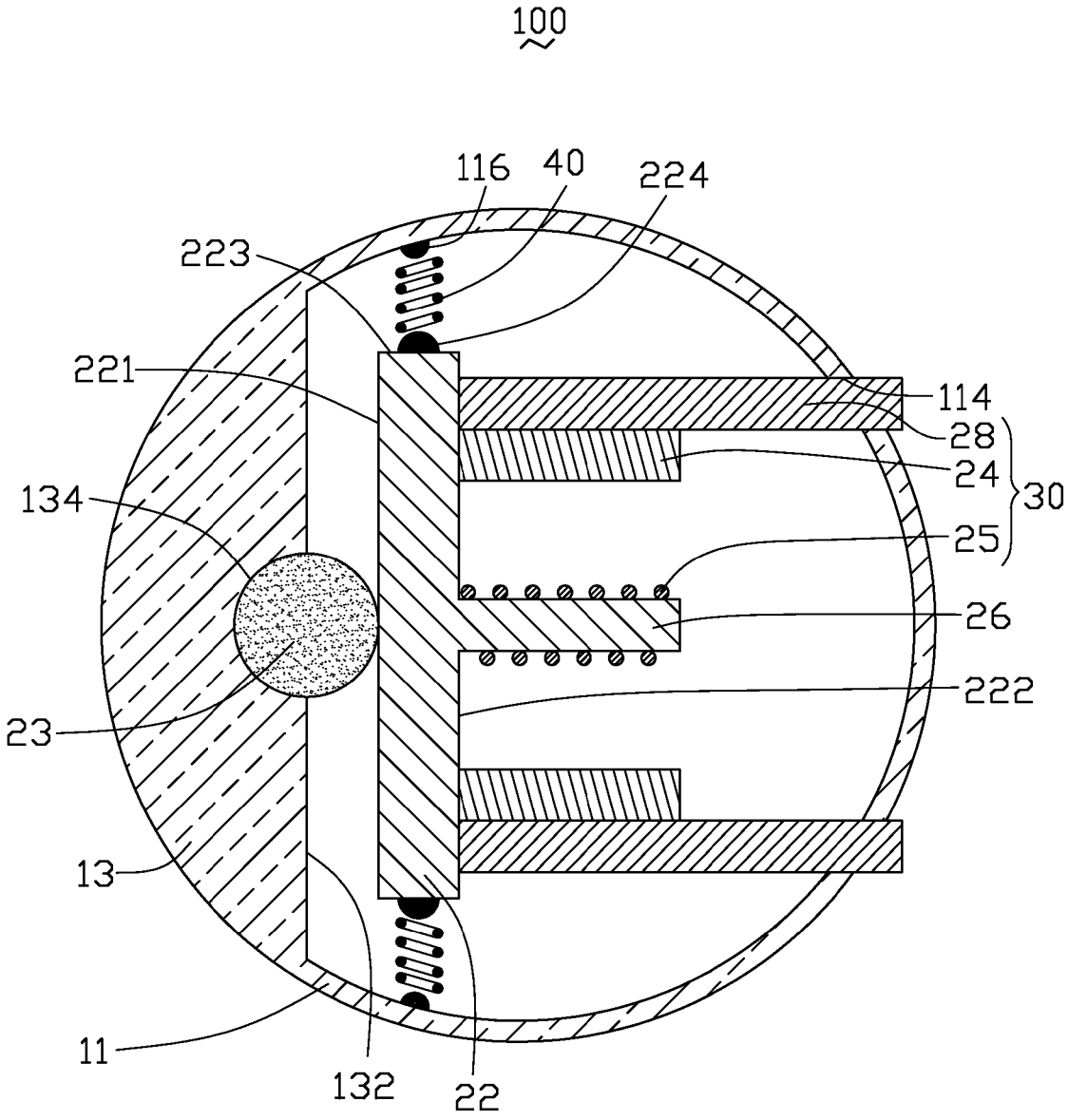
FIG. 1 is a cross-section of an eye as disclosed, showing driving components not electrically powered, and in which an elastic body is not depressed by a coil rod.
Figure 2:
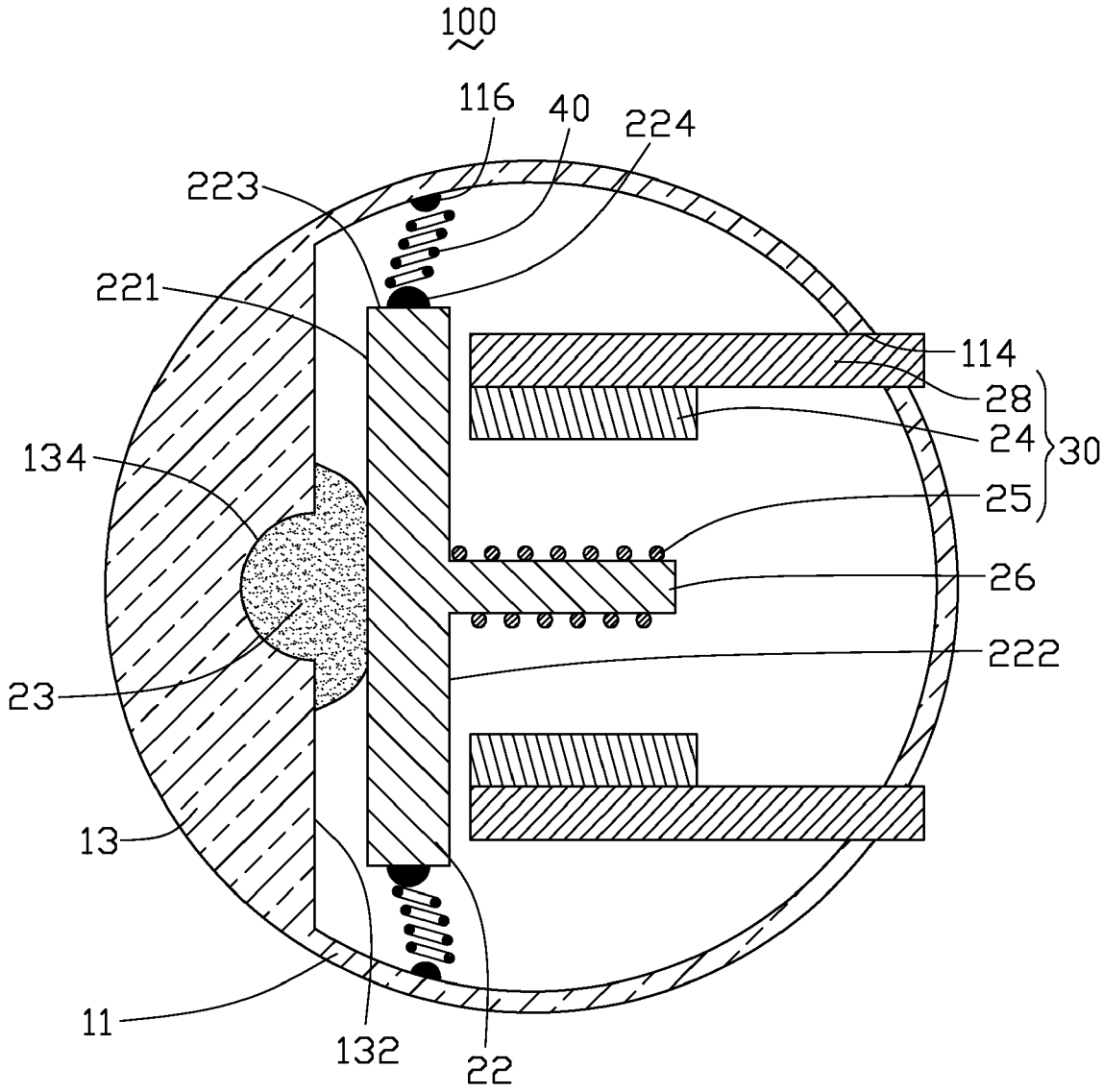
FIG. 2 is another cross-section of the disclosed eye, showing driving components being electrically powered, and an elastic body depressed by the coil rod.

FIG. 1 and FIG. 2 show an eye 100 as disclosed, comprising a spherical shell 11, a transparent body 13, a movable plate 22, an elastic body 23, and an electromagnetically driven assembly 30. The transparent body 13 acts as an intraocular lens, and the elastic body 23 mimics a pupil. Here, the spherical shell 11 and the transparent body 13 are manufactured integrally of transparent material with plasticity, such as silica gel, rubber or a combination. It is understandable that the transparent body 13 and the spherical shell 11 can be manufactured as two individual components rather than a whole body, and that spherical shell 11 can be glass, and the transparent body 13 can be of plastic material. Materials and manufacture of the spherical shell 11 and the transparent body 13 do not result in any limitation to the disclosure.

In a first embodiment of the disclosure, the elastic body 23 is a plastic ball. In another embodiment of the disclosure, the elastic body 23 is rubber. It is also understood that the elastic body 23 can have different colors, depending on design.

The movable plate 23 is provided opposite to the transparent body 13. The transparent body 13 comprises a back plate 132 opposite the movable plate 22. A recessed portion 134 defined in the center of the back plate 132 can be a hemisphere. The depth of the recessed portion 134 can be less than the diameter of the elastic body 23. The elastic body 23 is partially received in the recessed portion 134.

The movable plate 22 comprises a first surface 221, a second surface 222 located apart from the transparent body 13, and two sides 223 perpendicular to the first surface 221 and the second surface 222. A coil rod 26 extends from the center of the second surface 222, and it is perpendicular to the second surface 222. At least one first hook 224 is provided on each of the sides 223, and at least one second hook 116 is provided on the spherical shell 11 which is opposite to the first hook 224.

The eye 100 further comprises at least one resilient component 40, in this embodiment, a spring. One end of the resilient component 40 is connected to the first hook 224, and another end is connected to the second hook 116 to suspend the movable plate 22 in the spherical shell 11. In varied application, the resilient component can be a rubber band or any other resilient material.

The electromagnetic driving assembly 30 drives the movable plate 22 to approach or leave the elastic body 23 in a reciprocating motion. In this embodiment, the electromagnetic driving assembly 30 comprises two fastening portions 28, a first driving component 24 and a second driving component 25. The two fastening portions 28 surround the coil rod 26. In this embodiment, the fastening portions are parallel to the coil rod 26. Two openings 114 are separately provided on each of the fastening portions 28, and are shaped as a half-circle in this embodiment. The fastening portions 28 are movably inserted into the openings 114 provided on the spherical shell 11. It is understandable that a variety of ways to fasten the fastening portions 28 on the spherical shell 11, and the insertion of the fastening portions 28 into the spherical shell 11 which illustrated in this embodiment is not a limitation to the present disclosure. In another application, the recessed portions 114 may be provided on the first surface 221 of the movable plate 22, which can partially receive the elastic body 23.

In this embodiment, the two first driving components 24 are permanent magnets, and the second driving component 25 is embodied as an electromagnetic coil corresponding to the first driving components 24. The second driving component 25 winds around the coil rod 26, and each of the first driving components 24 is fastened to the fastening portions 28 correspondingly. The second driving component 25 is provided around the coil rod 26. The two first driving components 24 are separately formed on the two fastening portions 26, and are spaced apart from the second driving component 25. When the second driving components 25 are electrically powered, the resulting electric field generates a Lorentz force between the second driving components 25 and the first driving component 24. The Lorentz force reciprocates the movable plate 22 backward and forward, nearing or moving away from the elastic body 23. Thus, when movable plate 22 is impelled toward the elastic body 13 and away from the fastening portion 28, the elastic body 13 is compressed by the first surface 221, mimicking expansion of a pupil. When current is interrupted, the Lorentz force ceases, the coil rod 26 moves back to its original position, and the elastic body 13 returns to its original shape, mimicking contraction of the pupil.

For another exemplary application, the two first driving components 24 can be two electromagnetic coils, wound around the fastening portion 28. Correspondingly, the second driving component 25 can be a permanent magnet provided on the coil rod 26, and positioned relative to the first driving component 24. The relative arrangement of the fastening portion 28, the first driving component 24, and the second driving component 25 constitutes no limitation to the disclosed scope of the appended claims.

The electromagnetic driving assembly of the disclosure eye drives the movable plate in a translational way, compressing the elastic body to mimic expansion of the artificial pupil.

Figure 3:
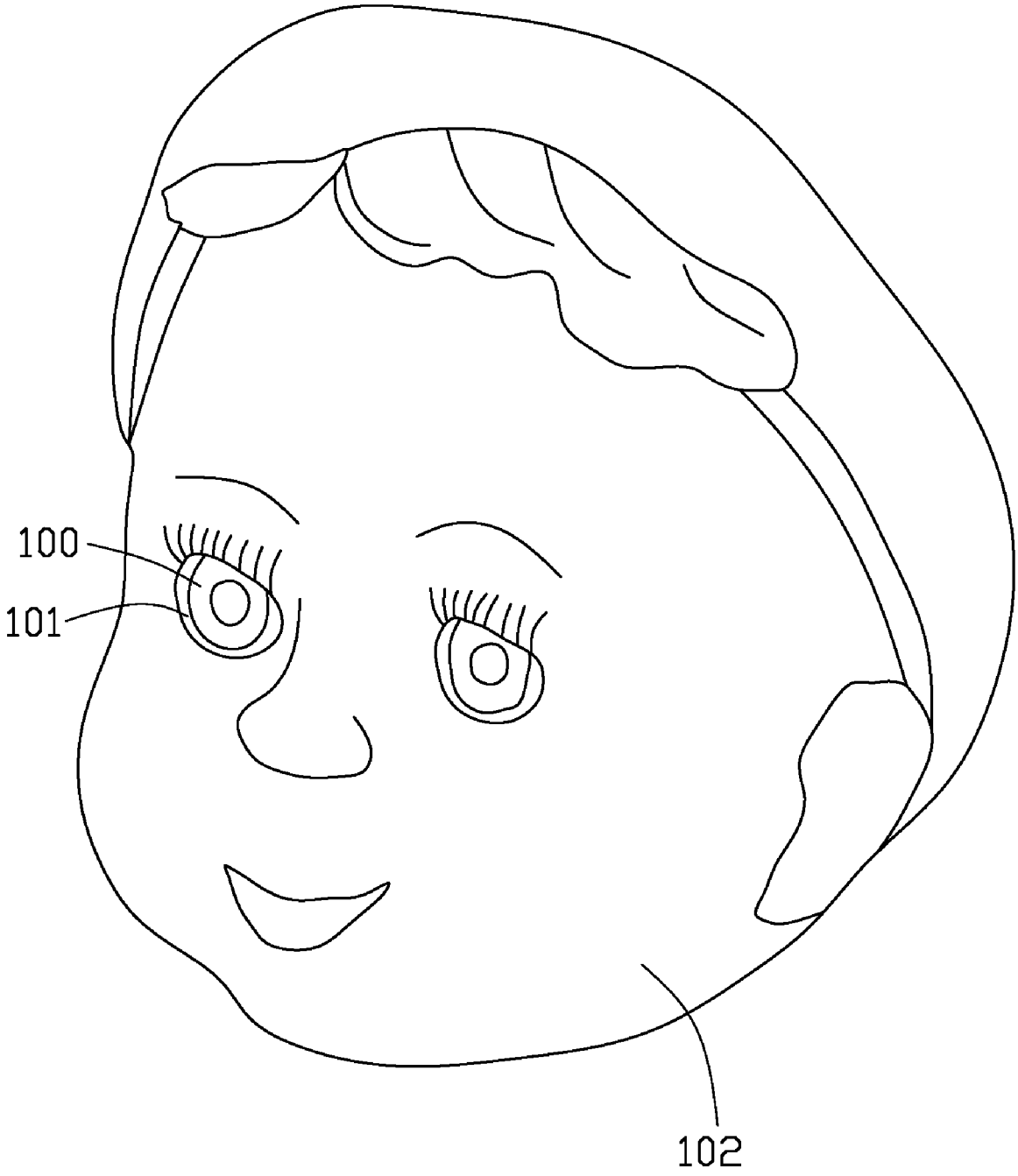
FIG. 3 is a toy system with the disclosed eye.

FIG. 3 discloses a toy system with the disclosed eye. The toy system comprises a recession 101 configured for receiving the eye 100 as disclosed, and a mask 102 configured for imitating a doll's face. It should be noted that the mask can be varied to any shape or any outline according to the requirements of users, and is not limited to the shown shape.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. An eye, comprising:

a substantially spherical shell;

a light pervious body having an inner surface;

a movable member suspended inside the spherical shell and movable relative to the shell, the movable member comprising a first surface facing toward the inner surface of the light pervious body, and an opposing second surface facing away from the light pervious body;

a rod disposed on the second surface of the movable member;

an elastic body disposed between the inner surface of the light pervious body and the movable member, the elastic body being deformable, by movement of the movable member toward or away from the light pervious body, between a first state where the elastic body has a first projection on the inner surface and a second state where the elastic body has a second projection greater than the first projection on the inner surface;

a driving device for moving the movable member toward or away from the light pervious body, thereby selectively deforming the elastic body to the first state or the second state;

wherein the driving device comprises two fastening portions, two first driving components and a second driving component, and the first driving components are disposed on the fastening portions respectively, and the second driving component is disposed on the rod.

2. The eye as claimed in claim 1, wherein two openings are defined in the spherical shell, and the fastening portions are engaged in the openings respectively.

3. The eye as claimed in claim 1, wherein each first driving component is a permanent magnet, and the second driving component is a coil.

4. The eye as claimed in claim 1, wherein each first driving component is a coil, and the second driving component is a permanent magnet.

5. The eye as claimed in claim 1, wherein the movable member comprises a first hook, and a second hook is provided on the spherical shell which corresponds to the first hook.

6. The eye as claimed in claim 5, further comprising at least one resilient component, one end of which is connected to the first hook, another end of which is connected to the second hook.

7. The eye as claimed in claim 6, wherein the light-pervious body and the shell are formed integrally.

8. The eye as claimed in claim 1, wherein the light pervious body comprises a recess defined in the inner surface, and the elastic body is partially received in the recess.

* * * * *